US009905330B2

(12) United States Patent
Watanabe et al.

(10) Patent No.: US 9,905,330 B2
(45) Date of Patent: Feb. 27, 2018

(54) FLEXIBLE CABLE

(71) Applicant: Hitachi Metals, Ltd., Tokyo (JP)

(72) Inventors: Takanobu Watanabe, Hitachi (JP); Kimika Kudo, Kitaibaraki (JP); Haruyuki Watanabe, Hitachi (JP); Detian Huang, Hitachi (JP)

(73) Assignee: HITACHI METALS, LTD., Tokyo (JP)

( * ) Notice: Subject to any disclaimer, the term of this patent is extended or adjusted under 35 U.S.C. 154(b) by 0 days.

(21) Appl. No.: 15/372,234

(22) Filed: Dec. 7, 2016

(65) Prior Publication Data

US 2017/0186513 A1 Jun. 29, 2017

(30) Foreign Application Priority Data

Dec. 25, 2015 (JP) ..... 2015-254821

(51) Int. Cl.

| | |
|---|---|
| ***H01B 7/02*** | (2006.01) |
| ***H01B 13/02*** | (2006.01) |
| ***H01B 13/24*** | (2006.01) |
| ***H01B 3/44*** | (2006.01) |

(52) U.S. Cl.

CPC ..... *H01B 3/441* (2013.01); *H01B 13/24* (2013.01); *H01B 7/0208* (2013.01)

(58) Field of Classification Search

CPC ..... H01B 7/048; H01B 3/441; H01B 7/0216; H01B 7/0275; H01B 13/02; H01B 13/24

USPC ..... 174/110 SR

See application file for complete search history.

(56) References Cited

U.S. PATENT DOCUMENTS

| | | | | |
|---|---|---|---|---|
| 9,165,699 | B2 * | 10/2015 | Kozawa | H01B 7/202 |
| 2008/0050590 | A1 * | 2/2008 | Rodway | H01B 3/105 428/394 |

FOREIGN PATENT DOCUMENTS

| | | | |
|---|---|---|---|
| JP | H 05-205537 | A | 8/1993 |
| JP | 2010235800 | * | 10/2010 |
| JP | 2011119271 | * | 6/2011 |

* cited by examiner

*Primary Examiner* — Timothy Thompson
*Assistant Examiner* — Charles Pizzuto
(74) *Attorney, Agent, or Firm* — McGinn IP Law Group, PLLC

(57) ABSTRACT

A flexible cable includes an outer sheath at an outermost portion. The outer sheath includes an inner layer made of an elastomer containing polypropylene resin, and an outer layer surrounding the inner layer and made of polypropylene resin.

3 Claims, 1 Drawing Sheet

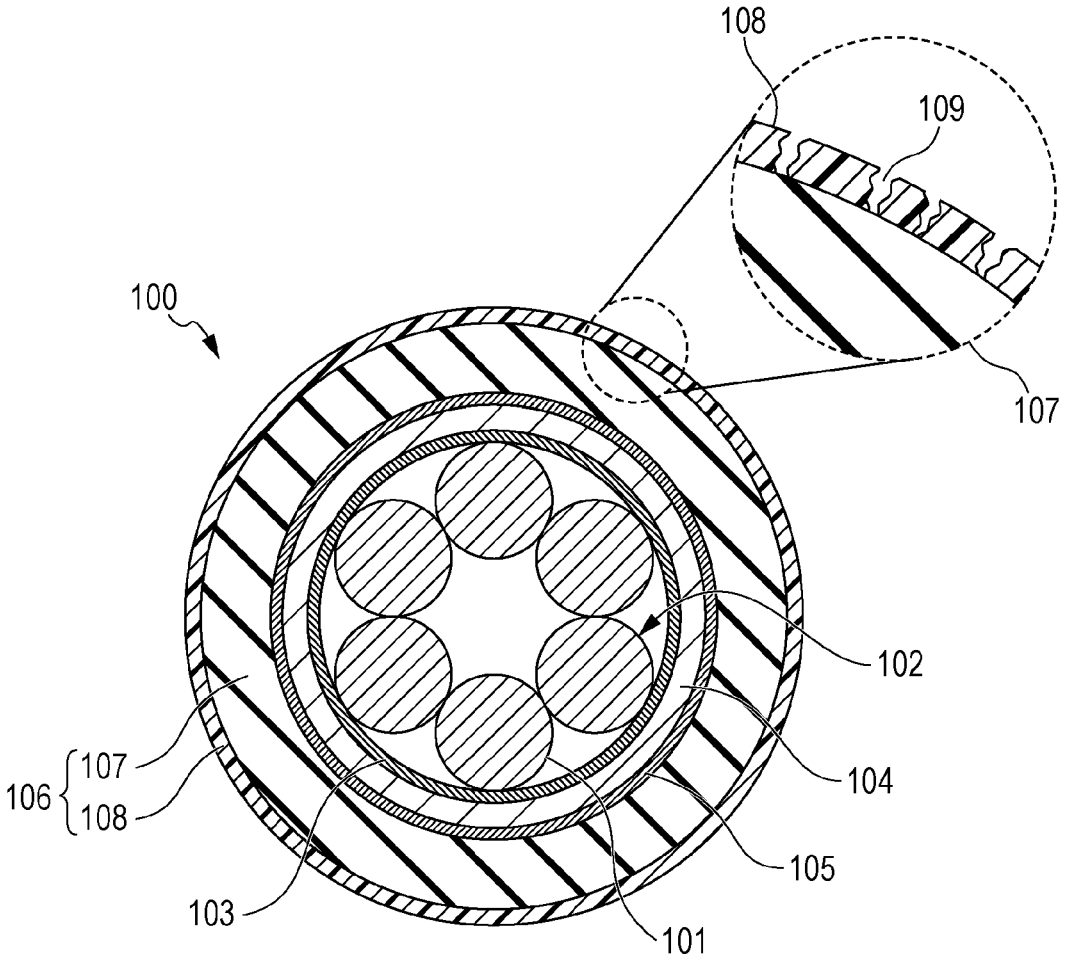
108
109
100
107
102
106
107
108
104
105
103
101

FLEXIBLE CABLE

The present application is based on Japanese patent application No. 2015-254821 filed on Dec. 25, 2015, the entire contents of which are incorporated herein by reference.

BACKGROUND OF THE INVENTION

1. Field of the Invention

The present invention relates to flexible cables handled manually by a human operator.

2. Description of the Related Art

In, for example, a health care site, health care professionals, such as doctors or nurses, are required to manually handle cables in some cases. For example, when providing an ultrasonic diagnosis, a health care professional has to manually handle a probe cable when applying a probe to an affected area. When providing endoscopy, a health care professional has to manually handle an endoscopic cable to insert an endoscope into the body. A flexible cable is thus used as a cable that requires manual handling, the flexible cable including an outer sheath made of a highly flexible material such as polyurethane resin, silicone rubber, a compound of styrene-based rubber and polypropylene resin, a compound of styrene-based rubber and polystyrene resin, or plasticized polyvinyl chloride (see, for example, Japanese Unexamined Patent Application Publication No. H5-205537).

SUMMARY OF THE INVENTION

However, a flexible cable including an outer sheath made of polyurethane resin, silicone rubber, a compound of styrene-based rubber and polypropylene resin, or a compound of styrene-based rubber and polystyrene resin is disadvantageous in that a human operator feels unsmoothness while manually handling the flexible cable because the outer sheath has a sticky surface. In the case of a flexible cable including an outer sheath made of plasticized polyvinyl chloride, the surface of the outer sheath is not sticky. However, the outer sheath made of plasticized polyvinyl chloride has lower thermal resistance than the outer sheet made of polyurethane resin, silicone rubber, a compound of styrene-based rubber and polypropylene resin, or a compound of styrene-based rubber and polystyrene resin. Thus, the outer sheath made of plasticized polyvinyl chloride is disadvantageous in that it may be damaged while being sterilized using an autoclave.

Accordingly, it is an object of the present invention to provide a flexible cable that is smoothly movable while being manually handled by a human operator and having an outer sheath that is less likely to be damaged while being sterilized using an autoclave.

The present invention is a flexible cable including an outer sheath at an outermost layer, the outer sheath including an inner layer made of an elastomer containing polypropylene resin and an outer layer surrounding the inner layer and made of polypropylene resin.

Desirably, the outer layer has a large number of cracks in a surface of the outer layer.

Desirably, the outer layer has a layer thickness of more than 0 μm and less than or equal to 100 μm.

Desirably, the outer layer is fusion-bonded with the inner layer.

The present invention is capable of providing a flexible capable that is smoothly movable while being manually handled by a human operator and having an outer sheath that is less likely to be damaged while being sterilized using an autoclave.

BRIEF DESCRIPTION OF THE DRAWINGS

The foregoing and other exemplary purposes, aspects and advantages will be better understood from the following detailed description of the invention with reference to the drawings, in which:

FIGURE is a cross-sectional view of a flexible cable according to an embodiment of the present invention.

DESCRIPTION OF THE PREFERRED EMBODIMENT

Referring now to the drawings, and more particularly to FIGURE, there is shown exemplary embodiments of the methods and structures according to the present invention.

An embodiment of the present invention is described below in accordance with the appended drawing.

As illustrated in FIGURE, a flexible cable 100 according to an embodiment of the present invention includes, for example, a strand 102 obtained by stranding multiple core wires 101 up, a first tape 103 wound around the strand 102, a braid shield 104 disposed around the first tape 103, a second tape 105 wound around the braid shield 104, and an outer sheath 106 disposed around the second tape 105.

The flexible cable 100 according to the embodiment of the present invention includes an outer sheath 106 at least at the outermost layer. The outer sheath 106 has a double layer structure including an inner layer 107, made of an elastomer containing polypropylene resin, and an outer layer 108, disposed around the inner layer 107 and made of polypropylene resin.

Examples of an elastomer containing polypropylene resin include Rabalon (registered trade mark), which is a compound of styrene-based rubber and polypropylene resin. Rabalon is a material having flexibility as high as the flexibility of a material such as polyurethane resin, silicone rubber, a compound of styrene-based rubber and polystyrene resin, or plasticized polyvinyl chloride. Moreover, Rabalon is a material having thermal resistance as high as the thermal resistance of silicone rubber, a compound of styrene-based rubber and polypropylene resin, or a compound of styrene-based rubber and polystyrene resin. Thus, using the inner layer 107 made of Rabalon can reliably provide the outer sheath 106 with flexibility and thermal resistance.

Rabalon, however, is a material having slidability as low as the slidability of a material such as polyurethane resin, silicone rubber, a compound of styrene-based rubber and polypropylene resin, or a compound of styrene-based rubber and polystyrene resin. Thus, when only the inner layer 107 made of Rabalon is used as an outer sheath, a human operator feels unsmoothness while manually handling the flexible cable because the outer sheath has a sticky surface. Thus, in the flexible cable 100 according to the embodiment of the present invention, a thin outer layer 108 made of polypropylene resin, which is a material having high thermal resistance and high slidability, is disposed around the inner layer 107 made of Rabalon to coat the inner layer 107.

Desirably, the outer layer 108 has a large number of cracks 109 in its surface. If the outer layer 108 has a large number of cracks 109 in its surface, the outer sheath 106 can have a smaller friction coefficient since the area over which the outer sheath 106 is brought into contact with other object is reduced. Thus, a human operator is less likely to feel unsmoothness while manually handling the flexible cable 100.

Desirably, the outer layer 108 has a layer thickness of more than 0 μm and less than or equal to 100 μm, more desirably, more than 0 μm and less than or equal to 50 μm. The reason why the layer thickness of the outer layer 108 of more than 0 μm and less than or equal to 100 μm is desirable is described as follows. If the layer thickness of the outer layer 108 exceeds 100 μm, the outer sheath 106 is more likely to have a protuberance (crease) as a result of the flexible cable 100 being bent. Thus, the outer sheath 106 is more likely to be easily foldable at a particular portion and may be broken at the portion. The reason why the layer thickness of the outer layer 108 of more than 0 μm and less than or equal to 50 μm is more desirable is because, a large number of cracks 109 are more likely to naturally occur in the surface of the outer layer 108 as the outer layer 108 has a smaller layer thickness.

Desirably, the outer layer 108 is fusion-bonded with the inner layer 107. By concurrently performing tube extrusion of the outer layer 108 and the inner layer 107 to surround the second tape 105, the outer layer 108 can be fusion-bonded with the inner layer 107 using the extrusion heat. When the outer layer 108 is fusion-bonded with the inner layer 107, the outer layer 108 is brought into close contact with the inner layer 107. Thus, the outer layer 108 is not separated from the inner layer 107 even when a large number of cracks 109 occur in the surface of the outer layer 108. Thus, the outer layer 108 can reliably fulfill its function.

As described above, the flexible cable 100 according to an embodiment of the present invention includes the outer sheath 106 having an unsticky surface while having high flexibility and high thermal resistance as a whole. Thus, a human operator is less likely to feel unsmoothness while manually handling the flexible cable 100 and the outer sheath 106 is less likely to be damaged while being sterilized using an autoclave.

Although the invention has been described with respect to specific exemplary embodiments for complete and clear disclosure, the appended claims are not to be thus limited but are to be construed as embodying all modifications and alternative constructions that may occur to one skilled in the art which fairly fall within the basic teaching herein set forth.

Further, it is noted that Applicant's intent is to encompass equivalents of all claim elements, even if amended later during prosecution.

What is claimed is:

1. A flexible cable comprising an outer sheath at an outermost portion, wherein the outer sheath includes:

an inner layer made of an elastomer containing polypropylene resin, and an outer layer surrounding the inner layer and made of polypropylene resin, wherein the outer layer has a large number of cracks in a surface of the outer layer.

2. The flexible cable according to claim 1, wherein the outer layer has a layer thickness of more than 0 μm and less than or equal to 100 μm.

3. The flexible cable according to claim 2, wherein the outer layer is fusion-bonded with the inner layer.

* * * * *